US010667339B1

(12) United States Patent
Blaker et al.

(10) Patent No.: US 10,667,339 B1
(45) Date of Patent: May 26, 2020

(54) CONVEYOR BELT

(71) Applicant: C.A. LITZLER CO., INC., Cleveland, OH (US)

(72) Inventors: Glenn Blaker, North Vancouver (CA); George L. Barber, Chagrin Falls, OH (US)

(73) Assignee: C.A. LITZLER CO., INC., Cleveland, OH (US)

( * ) Notice: Subject to any disclaimer, the term of this patent is extended or adjusted under 35 U.S.C. 154(b) by 247 days.

(21) Appl. No.: 15/927,548

(22) Filed: Mar. 21, 2018

Related U.S. Application Data

(60) Provisional application No. 62/474,980, filed on Mar. 22, 2017.

(51) Int. Cl.
*H05B 6/78* (2006.01)
*H05B 6/68* (2006.01)

(52) U.S. Cl.
CPC ..... *H05B 6/782* (2013.01)

(58) Field of Classification Search
CPC ..... H05B 5/78; H05B 6/68; Y02B 40/143
USPC ..... 219/762, 700, 702, 704, 705, 392, 388, 219/518; 99/DIG. 14, 451, 443 R, 443 C, 99/386; 427/8, 427.2, 424; 118/684, 118/692; 426/523, 243, 510
See application file for complete search history.

(56) References Cited

U.S. PATENT DOCUMENTS 2,019,087 A 10/1935 Morris et al.
3,843,813 A 10/1974 Driggs
5,556,567 A 9/1996 Landwehr et al.
5,700,504 A 12/1997 Hale, Jr.
5,843,505 A 12/1998 Davidson
6,113,961 A 9/2000 Polster
6,165,538 A 12/2000 Davidson
6,322,833 B1 11/2001 Davidson
6,406,727 B1 6/2002 Hamid-Samimi et al.
6,455,094 B1 9/2002 Ball et al.
6,692,784 B2 2/2004 Davidson
6,974,599 B2 12/2005 Vandepopuliere et al.
7,052,726 B2 5/2006 Park et al.
8,071,146 B2 12/2011 Erasmus et al.
8,569,667 B2 10/2013 Erasmus et al.
8,973,492 B1 3/2015 Geveke et al.
9,289,002 B2 3/2016 Lara
(Continued)

FOREIGN PATENT DOCUMENTS

WO 2010100613 A1 9/2010
WO 2015003080 A1 1/2015

OTHER PUBLICATIONS

Williams, C.D.H., "Boiling an Egg", PHYxxxx Everyday Physics, Exeter, 2006, pp. 1-2.
(Continued)

*Primary Examiner* — Quang T Van
(74) *Attorney, Agent, or Firm* — Pearne & Gordon LLP

(57) ABSTRACT

An apparatus for exposing an object to radio-frequency energy includes a conveyor, an radio-frequency generator, and a control system configured to automatically perform an operation. During the operation, the control system is configured to control the radio-frequency generator to apply radio-frequency energy to the object for a predetermined amount of time. Further, the conveyor rotates the objects as the object is conveyed through the radio-frequency energy.

9 Claims, 1 Drawing Sheet

(56) References Cited

U.S. PATENT DOCUMENTS

| | | | | |
|---|---|---|---|---|
| 2002/0041921 | A1 | 4/2002 | Davidson et al. | |
| 2003/0054076 | A1 | 3/2003 | Dibbs | |
| 2003/0143310 | A1 | 7/2003 | Davidson | |
| 2004/0011784 | A1 | 1/2004 | Dibbs | |
| 2005/0233057 | A1 | 10/2005 | McNulty | |
| 2006/0175232 | A1* | 8/2006 | Voloshyn | B03B 13/04 209/577 |
| 2006/0257581 | A1* | 11/2006 | Wulteputte | B05B 7/0815 427/427.2 |
| 2007/0202224 | A1 | 8/2007 | Erasmus et al. | |
| 2012/0114817 | A1 | 5/2012 | Signori et al. | |
| 2012/0258218 | A1 | 10/2012 | Koyun | |
| 2013/0199971 | A1* | 8/2013 | Thorsson | B07C 5/34 209/589 |
| 2015/0010679 | A1 | 1/2015 | Strong et al. | |
| 2016/0324170 | A1 | 11/2016 | Lara et al. | |

OTHER PUBLICATIONS

Kannan, Shrikalaa, "Effect of Radiofrequency Heating on the Dielectric and Physical Properties of Eggs", Progress in Electromagnetics Research B, vol. 51, 2013, pp. 201-220.

Nang, Jian, "Dielectric properties of egg whites and whole eggs as influenced by thermal treatments", LWT—Food Science and Technology, vol. 42, 2009, pp. 1204-1212.

Dev, S.R.S., "Optimization of Radio Frequency Heating of In-Shell Eggs Through Finite Element Modeling and Experimental Trials", Progress in Electromagnetics Research B, vol. 45, 2012, pp. 203-222.

The eUpdate, "New Radio-Wave Technique Kills Salmonella in Raw Eggs", John Wiley & Sons Inc., 2010, pp. 1-2.

Schoning, W., U.S. Pat. No. 0709583, dated Sep. 23, 1902, 1 page.

* cited by examiner

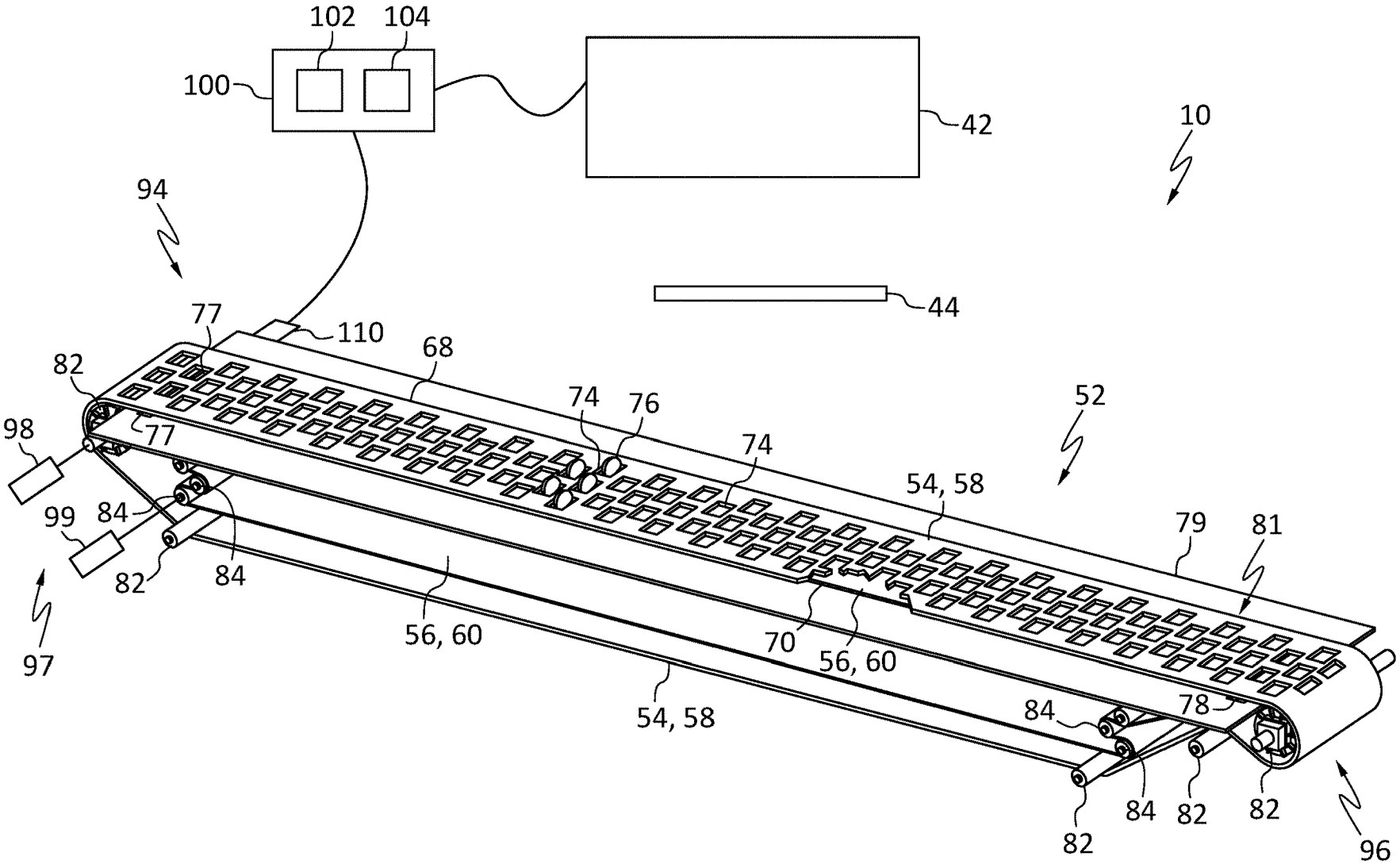
10
42
44
52
54, 58
56, 60
70
74
76
68
110
77
79
81
78
82
84
96
94
100
102
104
98
99
97

CONVEYOR BELT

TECHNICAL FIELD

The disclosure herein relates to a conveyor for use with a radio-frequency generator and a method of using the same. More particularly, objects on the conveyor are rotated to facilitate even absorption of radio-frequency energy.

BACKGROUND

Radio-frequency generators are used in various process applications. For example, radio-frequency generators can be used to expose objects, such as food, to radio-frequency energy in order to reduce or eliminate micro-organisms within or on the surface of such objects. The radio-frequency energy can be used to heat the objects to a predetermined temperature in order to destroy pathogenic organisms that affect the safety and shelf-life of the object.

SUMMARY

Unfortunately, radio-frequency energy as applied to an object may result in uneven heating, leading to "hot" and "cool" spots within and on the surface of the object, when radio-frequency energy is applied to a stationary object. In so-called "hot spots," the object may be heated to such a degree that it begins to deteriorate or decompose. In so-called "cold spots," the object does not reach the predetermined temperature and micro-organisms may not be reduced or eliminated.

It is an objective of the present disclosure to alleviate or overcome one or more difficulties related to the prior art. It has been found that the disclosed apparatus, conveyor, and conveyor belt system can be used to place a force on the object that causes the object to rotate, which allows for the even distribution of radio-frequency energy throughout the object.

In accordance with a first aspect, an apparatus includes a conveyor for conveying an object through an electrical energy field, such as a radio-frequency energy field. The apparatus further includes a radio-frequency generator that is operable to emit radio-frequency energy. The apparatus further includes a control system configured to control the radio-frequency generator and conveyor so as to automatically perform an operation. During the operation, the control system is configured to control the radio-frequency generator so as to apply radio-frequency energy to the object for a predetermined amount of time.

In accordance with a second aspect, a conveyor for conveying items though an electrical energy field, such as a radio-frequency energy field, includes a first belt that is movable along a first continuous loop, the first continuous loop including a first conveyor portion that is substantially linear. The conveyor further includes a second belt that is movable along a second continuous loop, the second continuous loop including a second conveyor portion that is substantially linear and spaced below the first conveyor portion of the first belt. The conveyor further includes a drive assembly that is operable to move the first belt along the first conveyor portion while the second belt is stationary or moving along the second conveyor portion at a different speed or direction than the first belt.

In accordance with a third aspect, a method for exposing an object to radio-frequency energy includes moving an object through radio-frequency energy and rotating the object as it moves through the energy.

BRIEF DESCRIPTION OF THE DRAWINGS

The foregoing and other aspects will become apparent to those skilled in the art to which the present examples relate upon reading the following description with reference to the accompanying drawings, in which:

FIG. 1 is a perspective view of an apparatus including a conveyor and a radio-frequency generator.

DETAILED DESCRIPTION OF THE PREFERRED EMBODIMENTS

The apparatus 10 includes a radio-frequency generator 42 that is operable to emit radio-frequency energy. The radio-frequency generator 42 includes one or more emitters 44 (e.g., electrodes) that can emit the radio-frequency energy when energized. In the present example, the radio-frequency generator 42 includes one emitter 44 that can emit radio-frequency energy. However, the radio-frequency generator 42 in other examples can include more than one emitter 44. Moreover, the energy emitted by each emitter 44 can be the same or the energy can vary in, for example, frequency or power.

The apparatus 10 can further include a conveyor 52 that can be operated to convey an object. The conveyor 52 can include at least one belt configured to move along a continuous loop that can support/move the object as the belt moves along the continuous loop. For instance, a conveyor 52 is shown in FIG. 1 that includes a first belt 54 and a second belt 56 and is particularly useful for conveying objects through electrical energy fields, such as radio-frequency energy fields.

As shown in FIG. 1, the first belt 54 is movable along a first continuous loop 58 and the second belt 56 is movable along a second continuous loop 60. The first and second continuous loops 58, 60 are imaginary paths that their corresponding belts 54, 56 can move along during conveyance. In the present example, each of the first and second belts 54, 56 extends along the entire perimeter of its corresponding loop and thus takes the form of (i.e., represents) its corresponding loop. However, in some examples, one or both of the belts 54, 56 may extend only partially about its associated loop.

The first and second continuous loops 58, 60 can respectively include first and second conveyor portions 68, 70. The first and second conveyor portions 68, 70 are substantially linear and are arranged such that the second conveyor portion 70 is spaced below the first conveyor portion 68. Preferably, the first and second conveyor portions 68, 70 are arranged substantially parallel to each other. More preferably, the first and second conveyor portions 68, 70 are arranged substantially horizontal. However, other non-parallel arrangements and/or degrees of inclination are possible in some examples. Moreover, in some examples, the first conveyor portion 68 and/or the second conveyor portion 70 may be slightly bowed rather than linear due to slack in the first belt 54 and/or the second belt 56.

The conveyor 52 further includes a support body 79 defining a substantially flat support surface 81 and first and second openings 77, 78 that extend through the support body 79. The support body 79 in the illustrated embodiment comprises a rectangular plate formed of a substantially rigid material such as, for example, metal or hard plastic. However, the support body 79 may comprise other shapes and/or materials in other examples.

The support body 79 is a stationary body positioned beneath the second conveyor portion 70 of the second loop 60 such that the support body 79 provides support for the second belt 56 as the second belt 56 conveys along the second conveyor portion 70, thereby inhibiting the second belt 56 from bowing due to, for example, slack or weight on the second belt 56. Moreover, the first and second openings 77, 78 of the support body 79 are provided at first and second ends 94, 96 of the conveyor 52 and are dimensioned such that the second belt 56 can advance through the openings 77, 78 as the second belt 56 moves along the second loop 60. In particular, the first and second openings 77, 78 are slightly larger than the width and thickness of the second belt 56 such that the second belt 56 can pass through the openings 77, 78 and be restrained from shifting laterally by the bounds of the openings 77, 78. However, it is to be appreciated that in some examples, the second belt 56 may not pass through openings in the support body 79 and may instead pass around the outer ends of support body 79. Furthermore, in some examples, the conveyor 52 may not include the support body 79.

Each of the belts 54, 56 can consist of a ribbon or a chain comprising aramid fibers, ethylene propylene (diene) terpolymer (EPDM), natural fibers (e.g., cotton, cellulose, or ramie), natural rubber, nitrile butadiene rubber (NBR), polypropylene, polyethylene (including high- and low-density polyethylene), PTFE (Teflon), urethane, polyester, polyvinylchloride (PVC), silicone rubber, or some other material. Fiberglass reinforcement can also be used in combination with the material of the ribbon or chain. In the present example, the first belt 54 consists of a ribbon comprising polypropylene that has one or more apertures 74 extending therethrough. Meanwhile, the second belt 56 consists of a substantially imperforate ribbon comprising urethane. However, other materials may be possible in other embodiments. Moreover, either of the belts 54, 56 may be perforated or imperforate in other examples.

In the present example, each aperture 74 in the first belt 54 is sized to receive an object 76 therethrough. The conveyor portions 68, 70 of the continuous loops 58, 60 are arranged (e.g., spaced) such that along the conveyor portions 68, 70, the object 76 can be received through an aperture 74 of the first belt 54 and supported by the second belt 56.

To align the first and second belts 54, 56 and permit movement of the first and second belts 54, 56 along their associated loops 58, 60, the conveyor 52 can include a first set of pulleys 82 and a second set of pulleys 84. The first belt 54 can extend about the first set of pulleys 82 and the second belt 56 can extend about the second set of pulleys 84. The first set of pulleys 82 can be configured such that rotation of one of the pulleys 82 will cause the first belt 54 to move about the pulleys 82 along the first continuous loop 58. Moreover, the first set of pulleys 82 can be configured such that a force applied to the first belt 54 along the first continuous loop 58 can cause the first belt 54 to move about the pulleys 82 along the first continuous loop 58. Likewise, the second set of pulleys 84 can be configured such that rotation of one of the pulleys 84 will cause the second belt 56 to move about the pulleys 84 along the second continuous loop 60. Moreover, the second set of pulleys 84 can be configured such that a force applied to the second belt 56 along the second continuous loop 60 can cause the second belt 56 to move about the pulleys 84 along the second continuous loop 60.

The conveyor 52 can include a drive system 97 having one or more motors that is operable to move either or both of the first and second belts 54, 56 along their associated loops 58, 60. In one embodiment, the drive system 97 includes a first motor 98 that is operable to rotate one of the pulleys 82 and cause the first belt 54 to rotate about the pulleys 82 along the first continuous loop 58. Moreover, the drive system 97 includes a second motor 99 that is operable to rotate one of the pulleys 84 and cause the second belt 56 to rotate about the pulleys 84 along the second continuous loop 60. However, in other examples, the drive system 97 may comprise a single motor that is operable to move both the first and second belts 54, 56 about their associated pulleys 82, 84 and loops 58, 60. Moreover, in some examples, the drive system 97 may be operable to move only one of the first and second belts 54, 56. In such examples, the belt not being moved by the drive system 97 may be stationary or the belt may be moved by other means (e.g., frictional engagement with the object(s) being conveyed by the other belt).

Preferably, the drive system 97 is operable to move the first belt 54 along the first conveyor portion 68 while the second belt 56 is stationary or moving along the second conveyor portion 70 at a different speed and/or direction than the first belt 54. For instance, in one example, the drive system 97 can be operated to move the first and second belts 54, 56 in the same direction but at different speeds along their associated conveyor portions 68, 70. More specifically, the first motor 98 of the drive system 97 can be operated to move the first belt 54 along the first conveyor portion 68 at a first speed such that as a portion of the first belt 54 moves along the first conveyor portion 68, the portion of the first belt 54 will move from the first end 94 of the conveyor 52 to the second end 96 of the conveyor 52, thus moving through the radio-frequency energy field. Meanwhile, the second motor 99 of the drive system 97 can be operated to move the second belt 56 along the second conveyor portion 70 at a second speed such that as a portion of the second belt 56 moves along the second conveyor portion 70, the portion of the second belt 56 will also move from the first end 94 of the conveyor 52 to the second end 96 of the conveyor 52. Preferably, the second speed of the second belt 56 is different than the first speed of the first belt 54. In particular, the second speed of the second belt 56 will preferably be smaller than the first speed of the first belt 54. However, in some cases, the second speed of the second belt 56 can be greater than the first speed of the first belt 54.

In another example, the drive system 97 can be operated to move the first belt 54 along the first conveyor portion 68 in a first direction and move the second belt 56 along the second conveyor portion 70 in a second direction that is opposite the first direction. More specifically, the first motor 98 of the drive system 97 can be operated to move the first belt 54 along the first conveyor portion 68 at a first speed such that as a portion of the first belt 54 moves along the first conveyor portion 68, the portion of the first belt 54 will move from the first end 94 of the conveyor 52 to the second end 96 of the conveyor 52, thus moving through the radio-frequency energy field. Meanwhile, the second motor 99 of the drive system 97 can be operated to move the second belt 56 along the second conveyor portion 70 at a second speed such that as a portion of the second belt 56 moves along the second conveyor portion 70, the portion of the second belt 56 will move from the second end 96 of the conveyor 52 to the first end 94 of the conveyor 52. In such an example, the first and second speeds of the first and second belts 54, 56 can be substantially similar or different.

In yet another example, the drive system 97 can be operated to move only the first belt 54. More specifically, the first motor 98 of the drive system 97 can be operated to move the first belt 54 along the first conveyor portion 68 at a first speed such that as a portion of the first belt 54 moves along the first conveyor portion 68, the portion of the first belt 54 will move from the first end 94 of the conveyor 52 to the second end 96 of the conveyor 52, thus moving through the radio-frequency energy field. Meanwhile, the second belt 56 can be stationary or moved by other means at a different speed or direction than the first belt 54.

By moving the first belt 54 while the second belt 56 is stationary or moving at a different speed or direction, the conveyor 52 can convey the object 76 through the radio-frequency energy field while placing a force on the object 76 that causes the object 76 to rotate. More specifically, the object 76 can be received through an aperture 74 of the first belt 54 and supported by the second belt 56 as described above. As the first belt 54 is moved by the drive system 97 through the first conveyor portion 68, the first belt 54 will place a lateral force on the object 76 that causes the object 76 to convey in the same direction as the first belt 54. If the second belt 56 remains stationary or is moved in a different direction or speed, the second belt 56 will place a drag force on the object 76 that can cause the object 76 to move (e.g., spin, rotate, turn, etc.) within the aperture 74 of the first belt 54, particularly if the object 76 is spherical. Thus, the conveyor 52 can rotate the object 76 while being conveyed. This can facilitate even heating of the object 76 throughout the process.

As shown in FIG. 1, the apparatus 10 can further comprise a control system 100 that is configured to control (e.g., operate) the radio-frequency generator 42 and/or the drive system 97 described above. The control system 100 includes a controller 102 (e.g., programmable logic controller) that can be operatively connected to the radio-frequency generator 42 and drive system 97. The control system 100 further includes a user interface 104 (e.g., display, touchscreen, keyboard, switches, etc.) that is connected to the controller 102 and can permit a user to selectively provide command signals to the controller 102. Furthermore, the control system 100 can include one or more sensors connected to the controller 102 that can be used to detect various parameters of the apparatus 10 and send signals to the controller 102 that are indicative of the detected parameters. For example, the control system 100 can include a temperature sensor that is configured to detect a temperature of the air surrounding the conveyor 52. As another example, the control system 100 can include a speed sensor 110 that is configured to detect the speed of the first belt 54 and/or second belt 56. The controller 102 can be any kind of microprocessor unit that is configured to receive one or more inputs (e.g., signals) and to control the radio-frequency generator 42 and/or drive system 97 based on the received input(s).

An example method of exposing an object to radio-frequency energy will be described that can be implemented using, for example, the apparatus 10 described above.

The object 76 can be conveyed through a radio-frequency energy field. A radio-frequency energy can be applied to the object for a predetermined amount of time $t_1$. The power level and the frequency of the radio-frequency energy will depend on factors such as, for example, production rate, industry standards (e.g., Industrial, Scientific, and Medical (ISM) frequency requirements), and size of the apparatus 10. However, other temperatures, times, power levels, frequencies, and/or types of objects 76 are possible in other examples. For instance, other suitable frequencies for the radio-frequency energy can be 13.56 or 40.68 MHz. Once the process is complete, the object 76 can then be conveyed out of the radio-frequency energy filed using, for example, the conveyor 52.

In some examples, the control system 100 described above can be configured to control the radio-frequency generator 42 and the drive system 97 of the conveyor 52 so as to automatically perform the process. For instance, one or more objects can be arranged within the apertures 74 of the first belt 54 such that the objects are supported by the second belt 56 near the first end 94 of the conveyor 52. A process can then be initiated by using, for example, the user interface 104 of the control system 100. In response to this initiation, the control system 100 can then automatically operate the drive system 97 of the conveyor 52 to convey the object(s) through the radio-frequency energy field. In particular, the controller 102 of the control system 100 can operate the first motor 98 to move the first belt 54 along the first conveyor portion 68 in a first direction (i.e., toward the second end 96) at a first speed. Moreover, the controller 102 can operate the second motor 99 to move the second belt 56 along the second conveyor portion 70 in a second direction at a second speed. As discussed above, the second direction may be opposite to the first direction. In addition or alternatively, the second speed may be different from (e.g., smaller than) the first speed. However, in some operations, the controller 102 may only operate the first motor 98 to move the first belt 54, while the second belt 56 remains stationary or moves passively in response to frictional engagement with the object(s) being conveyed by the first belt 54.

While the object is being conveyed, the control system 100 can automatically control the radio-frequency generator 42 to apply the radio-frequency energy to the object for a predetermined amount of time $t_1$. In particular, the control system 100 can operate the radio-frequency generator 42 to apply radio-frequency energy at, for example, 3 kW with a frequency of about 27.12 Mhz.

Once the radio-frequency energy has been applied for the predetermined amount of time $t_1$, the control system 100 can cease operation of the radio-frequency generator 42 and operate the drive system 97 of the conveyor 52 to convey the object out of the radio-frequency energy field and toward the second end 96 of the conveyor 52. This subsequent conveyance can be achieved by operating the first motor 98 to move the first belt 54 along the first conveyor portion 68 toward the second end 96. In some examples, the second motor 99 can also be operated to move the second belt 56 along the second conveyor portion 70. In this subsequent conveyance, the directions and speeds of the first belt 54 and second belt 56 along their respective conveyor portions 68, 70 can be substantially similar, since rotation of the object in the radio-frequency energy field is no longer a concern. However, even in this subsequent conveyance, the directions and/or speeds of the first belt 54 and second belt 56 may be different.

The invention has been described with reference to example embodiments described above. Modifications and alterations will occur to others upon a reading and understanding of this specification. Example embodiments incorporating one or more aspects described above are intended to include all such modifications and alterations insofar as they come within the scope of the appended claims.

What is claimed is:

1. An apparatus for conveying and heating an object, the apparatus comprising:

a conveyor for conveying the object;

a radio-frequency generator that is operable to emit radio-frequency energy;

a control system configured to control the radio-frequency generator when the object is on the conveyor so as to automatically perform a first heating operation, wherein during the first heating operation, the control system is configured to control the radio-frequency generator so as to apply the radio-frequency energy to the object for a predetermined amount of time, wherein the conveyor comprises:

a first belt that is movable along a first continuous loop, the first continuous loop comprising a first conveyor portion that is substantially linear;

a second belt that is movable along a second continuous loop, the second continuous loop comprising a second conveyor portion that is substantially linear and spaced below the first conveyor portion of the first belt;

a drive system that is operable to move the first belt along the first conveyor portion at a first speed while the second belt is stationary or moves along the second conveyor portion at a second speed that is different than the first speed; and a support body arranged beneath the second conveyor portion such that the support body provides support for the second belt as the second belt conveys along the second conveyor portion.

2. The apparatus of claim 1, wherein the first belt comprises one or more apertures for receiving the object therethrough.

3. The apparatus of claim 1, wherein the drive system is operable to move the first belt along the first conveyor portion in a first direction and move the second belt along the second conveyor portion in a second direction that is opposite the first direction.

4. The apparatus of claim 1, wherein the control system further comprises a speed sensor configured to detect the speed of the first belt and/or second belt.

5. The apparatus of claim 1, wherein the control system further comprises a controller to receive one or more inputs and control the radio-frequency generator and/or the drive system.

6. A conveyor for conveying an object though an electrical energy field, the conveyor comprising:

a first belt that is movable along a first continuous loop, the first continuous loop comprising a first conveyor portion that is substantially linear;

a second belt that is movable along a second continuous loop, the second continuous loop comprising a second conveyor portion that is substantially linear and spaced below the first conveyor portion of the first belt;

a drive system that is operable to move the first belt along the first conveyor portion while the second belt is stationary or moving along the second conveyor portion at a different speed or direction than the first belt; and a support body arranged beneath the second conveyor portion such that the support body provides support for the second belt as the second belt conveys along the second conveyor portion.

7. The conveyor of claim 6, wherein the first belt comprises one or more apertures for receiving the object therethrough.

8. The conveyor of claim 6, wherein the drive system is operable to move the first belt along the first conveyor portion in a first direction and move the second belt along the second conveyor portion in a second direction that is opposite the first direction.

9. The conveyor of claim 6, wherein:

the drive system moves the first belt such that as a portion of the first belt moves along the first conveyor portion, the portion of the first belt moves from a first end of the conveyor to a second end of the conveyor; and the drive system moves the second belt such that as a portion of the second belt moves along the conveyor portion of the second continuous loop, the portion of the second belt moves from the second end of the conveyor to the first end of the conveyor.

* * * * *